US006516779B2

(12) United States Patent
Ikeda

(10) Patent No.: US 6,516,779 B2
(45) Date of Patent: Feb. 11, 2003

(54) THROTTLE ADJUSTING APPARATUS FOR WORKING MACHINE

(75) Inventor: Takashi Ikeda, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/760,041

(22) Filed: Jan. 12, 2001

(65) Prior Publication Data

US 2001/0008132 A1 Jul. 19, 2001

(30) Foreign Application Priority Data

Jan. 18, 2000 (JP) ..... 2000-009518

(51) Int. Cl.[7] ..... F02D 9/02; F02D 37/00

(52) U.S. Cl. ..... 123/400; 123/198 DB; 123/198 DC; 123/437

(58) Field of Search ..... 123/400, 403, 123/198 DB, 198 DC, 179.18, 442, 437

(56) References Cited

U.S. PATENT DOCUMENTS 4,885,903 A * 12/1989 Scag ..... 56/10.8
6,082,323 A * 7/2000 Winberg ..... 123/198 DB

FOREIGN PATENT DOCUMENTS

JP 60170290 11/1985

* cited by examiner

*Primary Examiner*—Tony M Argenbright
(74) *Attorney, Agent, or Firm*—Adams & Wilks

(57) ABSTRACT

A throttle adjusting apparatus for use with a machinery for soil management includes a throttle cable. The throttle cable has one end portion to which a throttle valve, a choke valve, and a fuel cock are connected. The apparatus further includes a throttle lever. The throttle lever is disposed to pivot in a plane perpendicular to a longitudinal direction of a central axis of a grip mounted to a handle of the machinery. The throttle lever is connected to another end portion of the throttle cable. The throttle valve, the choke valve, and the fuel cock are operated simultaneously by means of the throttle lever.

15 Claims, 15 Drawing Sheets

FIG. 8

| | ① | ② | ③ | ④ | ⑤ | ⑥ | ⑦ |
|---|---|---|---|---|---|---|---|
| | ENGINE NOT OPERATED | FUEL COCK OPEN | ENGINE SWITCH ON | CHOKE VALVE CLOSED | ENGINE STARTED | CHOKE VALVE OPEN | THROTTLE VALVE ADJUSTED |
| I | • FUEL COCK CLOSED<br>• ENGINE SWITCH OFF<br>• CHOKE VALVE OPEN<br>• THROTTLE VALVE CLOSED | CLOSE OPEN | OFF ON | CHOKE KNOB | STARTING GRIP | CHOKE KNOB | THROTTLE LEVER |
| II | θ1 【SEE FIG.10】 | θ1 【SEE FIG.12】 | θ1 【SEE FIG.12】 | θ2 【SEE FIG.11】 | θ2 | θ3 | θ1 |
| | FUEL COCK CLOSED | OPEN | OPEN | OPEN | OPEN | OPEN | OPEN |
| | ENGINE SWITCH OFF | ON | ON | ON | ON | ON | ON |
| | CHOKE VALVE OPEN | OPEN | OPEN | CLOSED | CLOSED | OPEN | OPEN |
| | THROTTLE VALVE SLIGHTLY OPEN | SLIGHTLY OPEN | SLIGHTLY OPEN | FULLY OPEN | FULLY OPEN | FULLY OPEN | SLIGHTLY OPEN |

THROTTLE ADJUSTING APPARATUS FOR WORKING MACHINE

BACKGROUND OF THE INVENTION

1. Field of the Invention

The present invention relates generally to a working machine, and in particular to a throttle adjusting apparatus for the machine having a throttle lever with which plural functions including the operation of a throttle valve are achieved.

2. Description of the Related Art

There are known throttle adjusting apparatuses for adjusting amounts by which throttle valves of carburetors provided in the proximity of engines are opened. One example of such apparatuses is disclosed in, for example, Japanese Utility Model Laid-Open Publication No. SHO 60-170290 entitled "OPERATING APPARATUS FOR BICYCLE HAVING PRIME MOVER".

The disclosed apparatus is mounted on a handlebar of a bicycle. The apparatus includes a throttle lever positioned adjacent to a handgrip mounted on an end portion of the handlebar. The lever lies in a plane perpendicular to a longitudinal direction of an axis of the handgrip. The lever is designed to pivot on the axis. The apparatus also includes a throttle control cable connected to the throttle lever. When the throttle lever pivots on the axis, a throttle shaft disposed within a carburetor is operated by means of the throttle control cable. The apparatus further includes a switch lever lying in the plane perpendicular to the longitudinal direction of the axis. The switch lever is designed to pivot on the axis, as is the throttle lever. When the switch lever pivots to an on position, a prime mover of the bicycle is operated to drive a rear wheel of the bicycle.

However, it is difficult or troublesome for a rider to properly operate these two different types of levers because they are disposed closely to each other. For example, even if the rider attempts to operate one of the throttle lever and switch lever, he can inadvertently operate the other one.

Further, the throttle lever is positioned more closely to the handgrip than the switch lever. Thus, the throttle lever can hinder the rider from operating the switch lever.

SUMMARY OF THE INVENTION

It is therefore an object of the present invention to provide a throttle adjusting apparatus for a working machine including a single lever with which a plurality of functions including the operation of a throttle valve are achieved.

According to an aspect of the present invention, there is provided a throttle adjusting apparatus for a working machine, comprising: a throttle wire attachable to the working machine in such a manner as to extend along a longitudinal direction of a handle of the working machine, the throttle wire having one end portion connected to respective ones of a throttle valve, a choke valve, and a fuel cock; and a throttle lever pivotable in a plane perpendicular to a longitudinal direction of a grip of the handle, the throttle lever being connected to another end portion of the throttle wire, such that the throttle lever is operated to simultaneously adjust amounts by which respective ones of the throttle valve, the choke valve, and the fuel cock are opened.

The one end portion of the throttle wire is connected to respective ones of the throttle valve, the choke valve, and the fuel cock while another end portion of the throttle wire is connected to the throttle lever. Provision of the throttle lever makes it possible to simultaneously and coordinately adjust amounts by which respective ones of the throttle valve, the choke valve, and the fuel cock are opened. That is, the throttle lever is operated to open and close the choke valve and the fuel cock and to adjust the amount the throttle valve is opened.

The simultaneous and coordinated operations of the throttle lever, the choke valve, and the fuel cock can be achieved using the throttle lever alone to thereby provide improved operational performance of the working machine.

In a preferred form of the present invention, the fuel cock is in one of an opened position and a closed position when the throttle lever is in a minimum position where the throttle valve is opened a minimum amount, the choke valve being in one of an opened position and a closed position when the throttle layer is pivoted from the minimum position to a maximum position where the throttle valve is opened a maximum amount.

The amount of pivotal movement of the throttle lever determines whether the fuel cock and the choke valve are opened or closed, in addition to the amount by which the throttle valve is opened.

Alternatively stated, the pivotal movement of the throttle lever allows the simultaneous operations of the fuel cock, the choke valve, and the throttle valve.

The working machine can thus be rapidly and readily operated to thereby provide improved operational performance and working capacity thereof.

Further, the throttle lever is disposed proximate the grip. An operator can thus operate the throttle lever by his hand grasping the grip, so as to bring the engine into and out of operation as well as adjusting the amount by which the throttle valve is opened. With the throttle lever thus arranged, the operator need not move his hand a lot so as to perform the respective operations. The working machine can thus be made easy to operate. This results in improved operational performance of the working machine.

In a further preferred form of the present invention, the throttle adjusting apparatus further comprises an engine switch disposed proximate the handle of the working machine, the engine switch being operated to determine whether a spark plug of an engine of the working machine is supplied with a power required to produce a spark thereat.

The engine switch can be switched between an on state and an off state by the operator's hand grasping the grip.

Because the engine switch is disposed proximate the handle rather than the engine, the operator need not bring his hand to the engine when operating the engine switch. This leads to improved operational performance of the working machine.

In a still further preferred form of the present invention, the one end portion of the throttle wire is connected to an engine switch, such that the engine switch is switched between an on state and an off state by means of the throttle lever, when the engine switch is in the on state, a spark plug of an engine of the working machine being supplied with a power required to produce a spark thereat, when the throttle lever is in the minimum position, the engine switch being in one of the on state and the off state.

The amount of pivotal movement of the throttle lever determines whether the fuel cock and the choke valve are opened or closed and whether the engine switch is switched to the on state or the off state, in addition to the amount the throttle valve is opened.

The engine switch can thus be operated with the throttle lever. With the thus arranged throttle lever, the working machine can be readily operated to provide improved operational performance and working capacity thereof.

The engine switch is not disposed proximate the engine but is connected to the throttle lever. The operator can thus operate the throttle lever by his hand grasping the grip, so as to bring the engine into and out of operation. The operator can operate the working machine with reduced burden imposed thereon.

BRIEF DESCRIPTION OF THE DRAWINGS

Certain preferred embodiments of the present invention will hereinafter be described in detail, by way of example only, with reference to the accompanying drawings, in which:

FIG. 8 is a view showing how the working machine of FIG. 1 which employs the throttle adjusting apparatus is operated and how a working machine which does not employ the throttle adjusting apparatus is operated.

DETAILED DESCRIPTION OF THE PREFERRED EMBODIMENT

The following description is merely exemplary in nature and is in no way intended to limit the invention or its application or uses.

Figure 1:
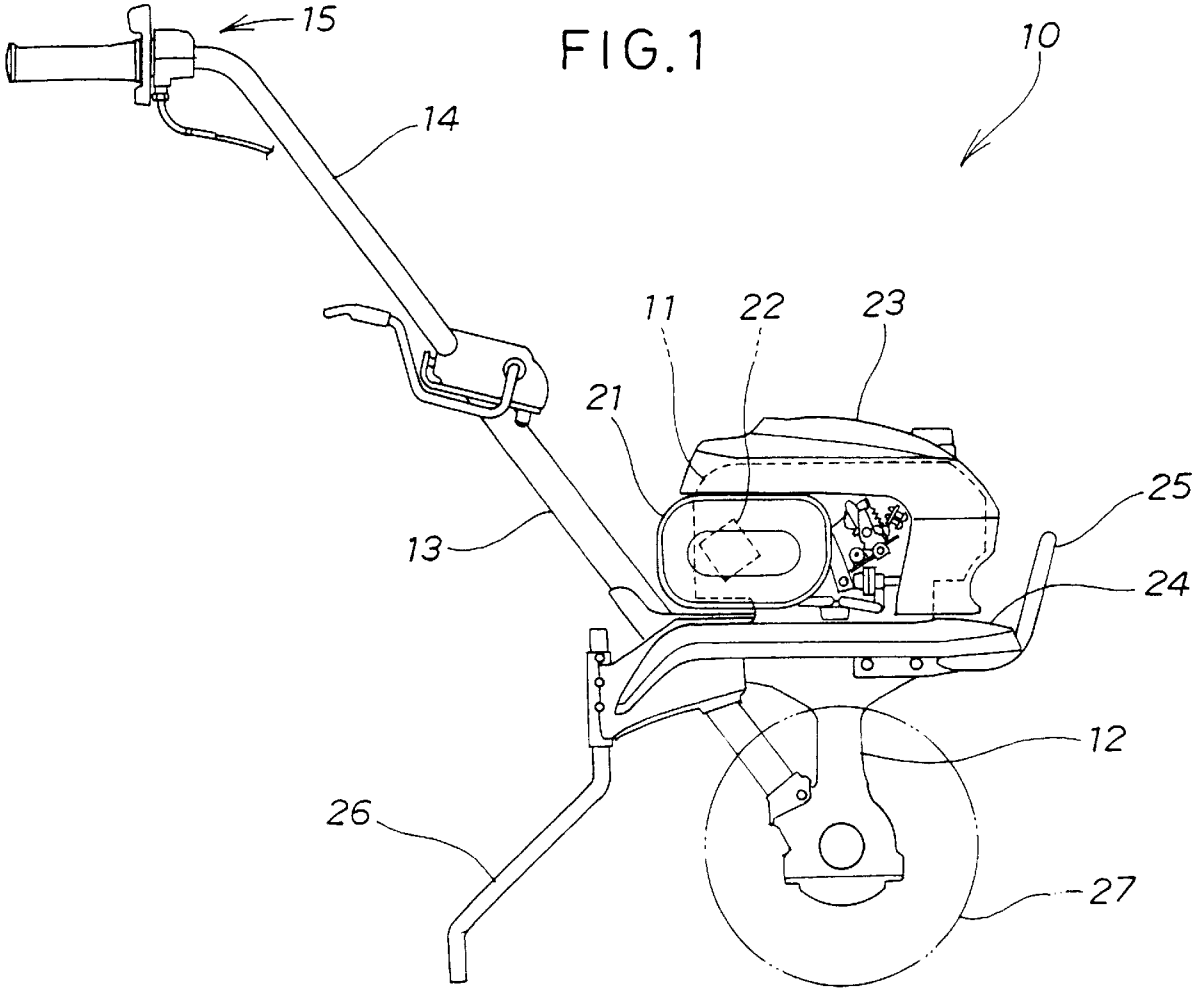
FIG. 1 is a side elevation view of a working machine employing a throttle adjusting apparatus according to a first embodiment of the present invention.

Reference is made to FIG. 1. A working machine or a machinery 10 for soil management includes an engine 11. Below the engine 11, there is mounted a gear case 12 for transmitting to tillage tines (not shown) a motive power produced by the engine 11. The gear case 12 has a handle post 13 extending upwardly and backwardly from a rear end portion thereof. A handle 14 is attached to an upper part of the handle post 13. Mounted to the handle 14 is a throttle adjusting apparatus 15 according to a first embodiment of the present invention. Reference numerals 21, 22 designate an air cleaner and a carburetor, respectively. The engine 11 is covered with a cover 23. The machinery 10 includes a cover 24. By virtue of such a cover 24, soil tilled by the tillage tines is prevented from scattering. Reference numeral 25 depicts a guard member for the machinery 10. Reference numeral 26 designates a skid. Reference numerals 27, 27 denote side discs (only one of which is shown).

Figure 2:
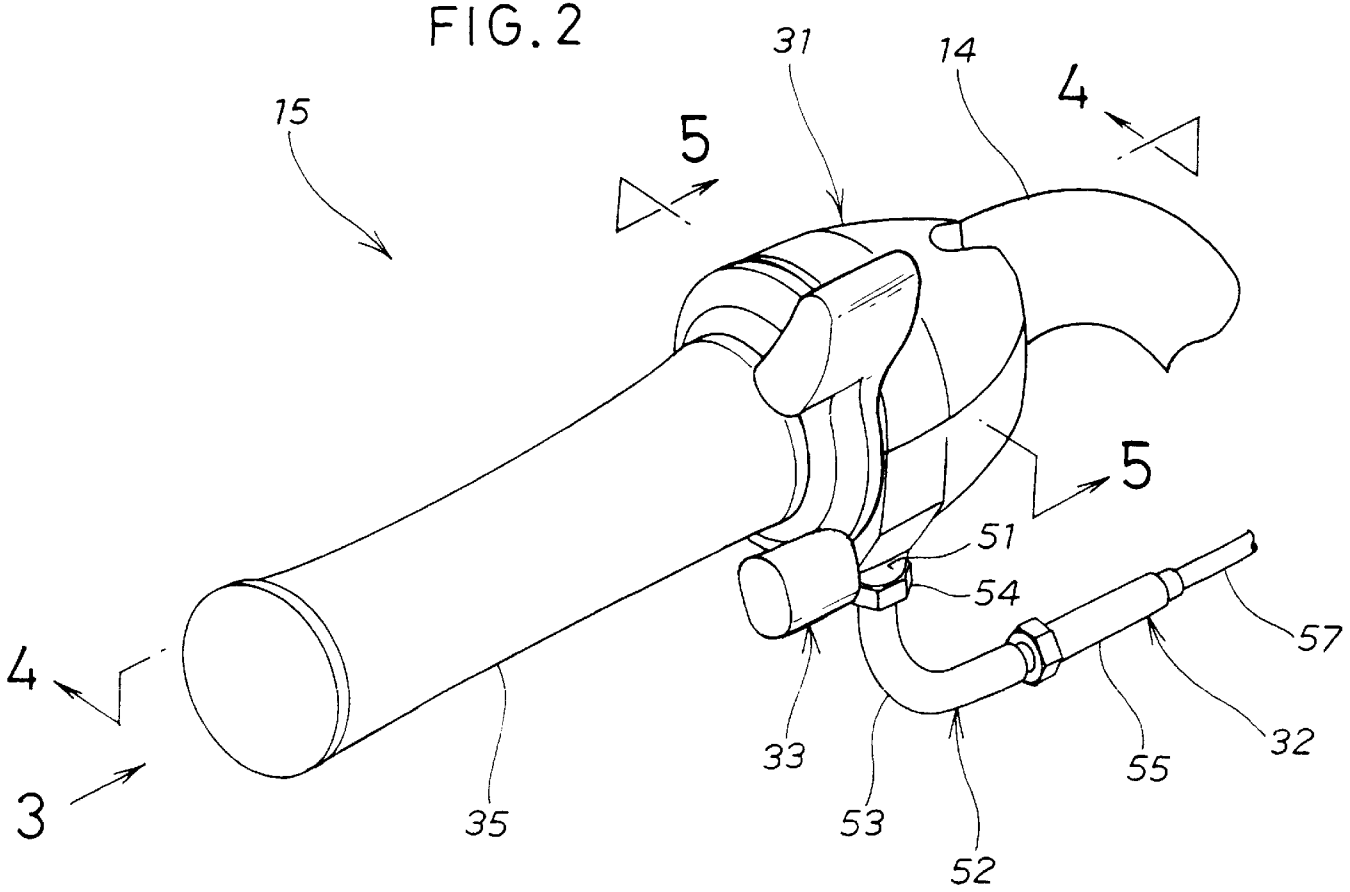
FIG. 2 is a perspective view of the throttle adjusting apparatus of FIG. 1.

Turning to FIG. 2, the throttle adjusting apparatus 15 comprises a case 31 attached to the handle 14, a throttle cable or throttle wire 32 mounted to a lower part of the case 31, and a pivotable throttle lever 33 mounted to the case 31. A grip 35 is attached to an end portion of the handle 14.

Figure 3:
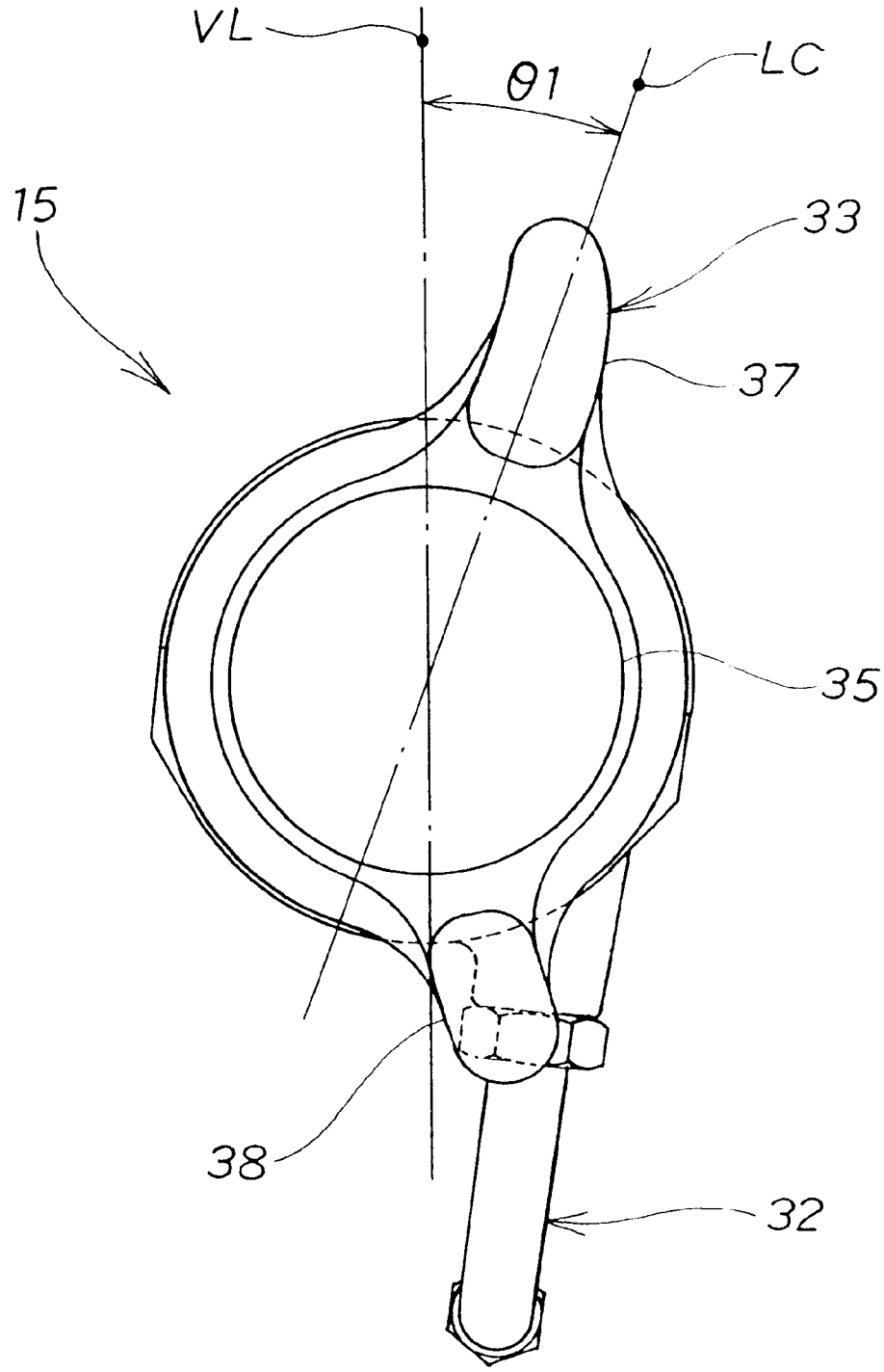
FIG. 3 is a view showing the throttle adjusting apparatus as viewed in a direction indicated by an arrow 3.

As illustrated in FIG. 3, the throttle lever 33 includes first and second lever portions 37, 38. The lever portions 37, 38 can be pivoted by the thumb or index finger of an operator's hand.

Each of the first and second lever portions 37, 38 is positioned in an initial position where the engine 11 is out of operation. In the initial position, the first lever portion 37 has a center axis LC inclined θ1 degrees clockwise away from a vertical line VL.

Figure 4:
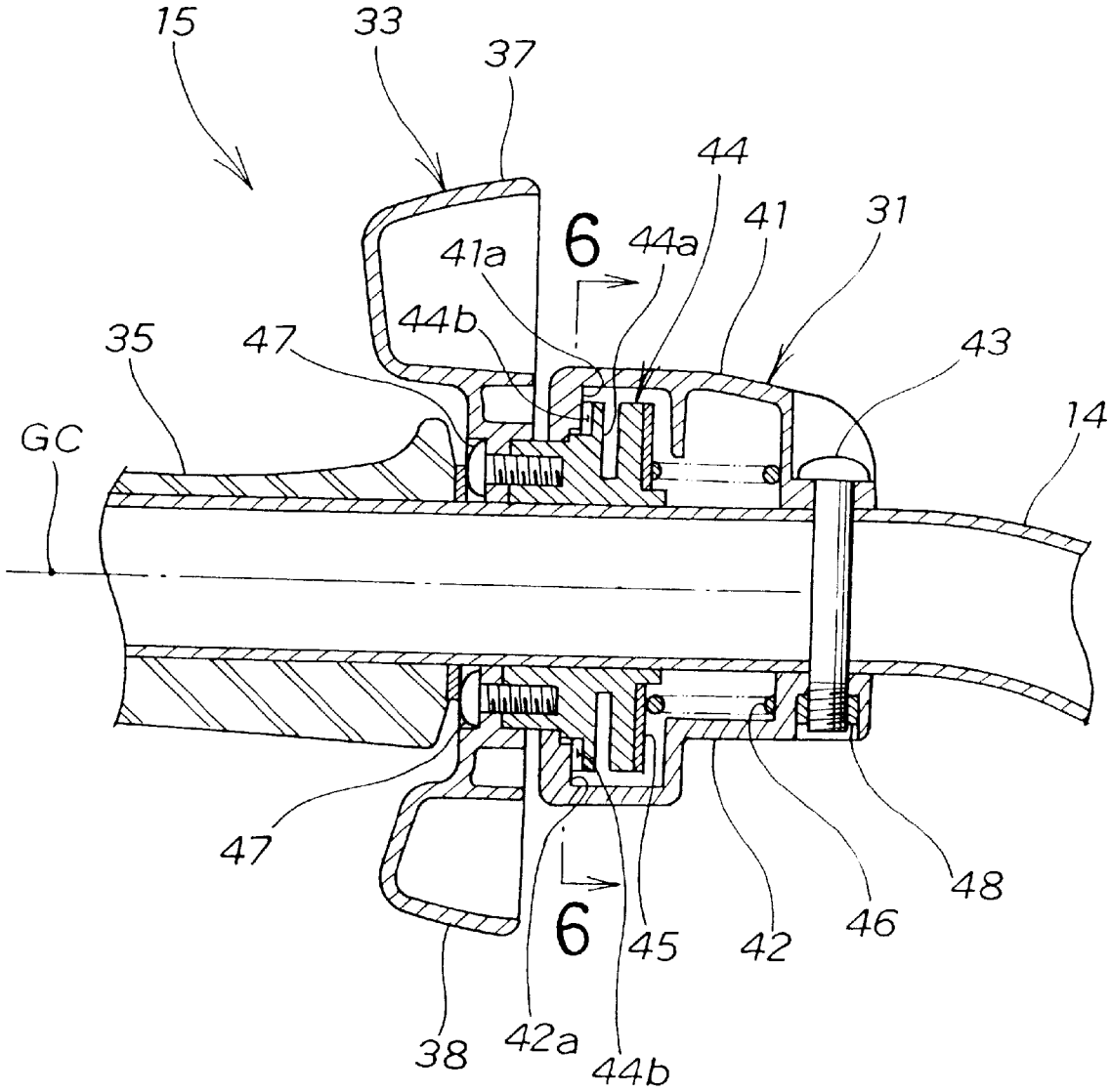
FIG. 4 is a cross-sectional view taken along line 4—4 of FIG. 2.

Referring next to FIG. 4, the case 31 of the throttle adjusting apparatus 15 is comprised of upper and lower halves 41, 42. The halves 41, 42 are attached to the handle 14 by means of a screw 43. A pulley 44 is disposed within the case 31 and is rotatably mounted on the handle 14. The apparatus 15 also includes a retainer 45 and a coil spring 46. The coil spring 46 urges the pulley 44 with the retainer 45 provided therebetween. The pulley 44 thus arranged and the case 31 are disposed to provide a friction therebetween. The throttle lever 33 is mounted to the pulley 44 through screws 47, 47.

The upper half 41 has a case side cam portion 41*a* provided on an inner surface thereof while the lower half 42 has a case side cam portion 42*a* provided on an inner surface thereof. The pulley 44 has an annular groove 44*a* formed therein. The pulley 44 has pulley side cam portions 44*b*, 44*b* provided on a side surface thereof. Reference numeral 48 denotes a nut. The upper and lower halves 41, 42 are coupled together through two screws (not shown) which do not extend through the handle 14.

The handle 14 and the grip 35 attached to the handle 14 have a central axis GC in common.

The throttle lever 33 lies in a plane perpendicular to a longitudinal direction of the axis GC of the grip 35. The lever 33 is disposed to pivot on the axis GC.

Since the throttle lever is pivotable in the plane perpendicular to the longitudinal direction of the axis GC, the lever 33 can be pivoted by the thumb or index finger of the operator's hand by which the grip 35 is grasped. This arrangement enables an operator to grasp the grip 35 of the handle 14 and operate the lever 33 easily.

Accordingly, the operator can steadily manipulate the machinery 10 to thereby provide improved working capacity of the machinery 10.

Figure 5:
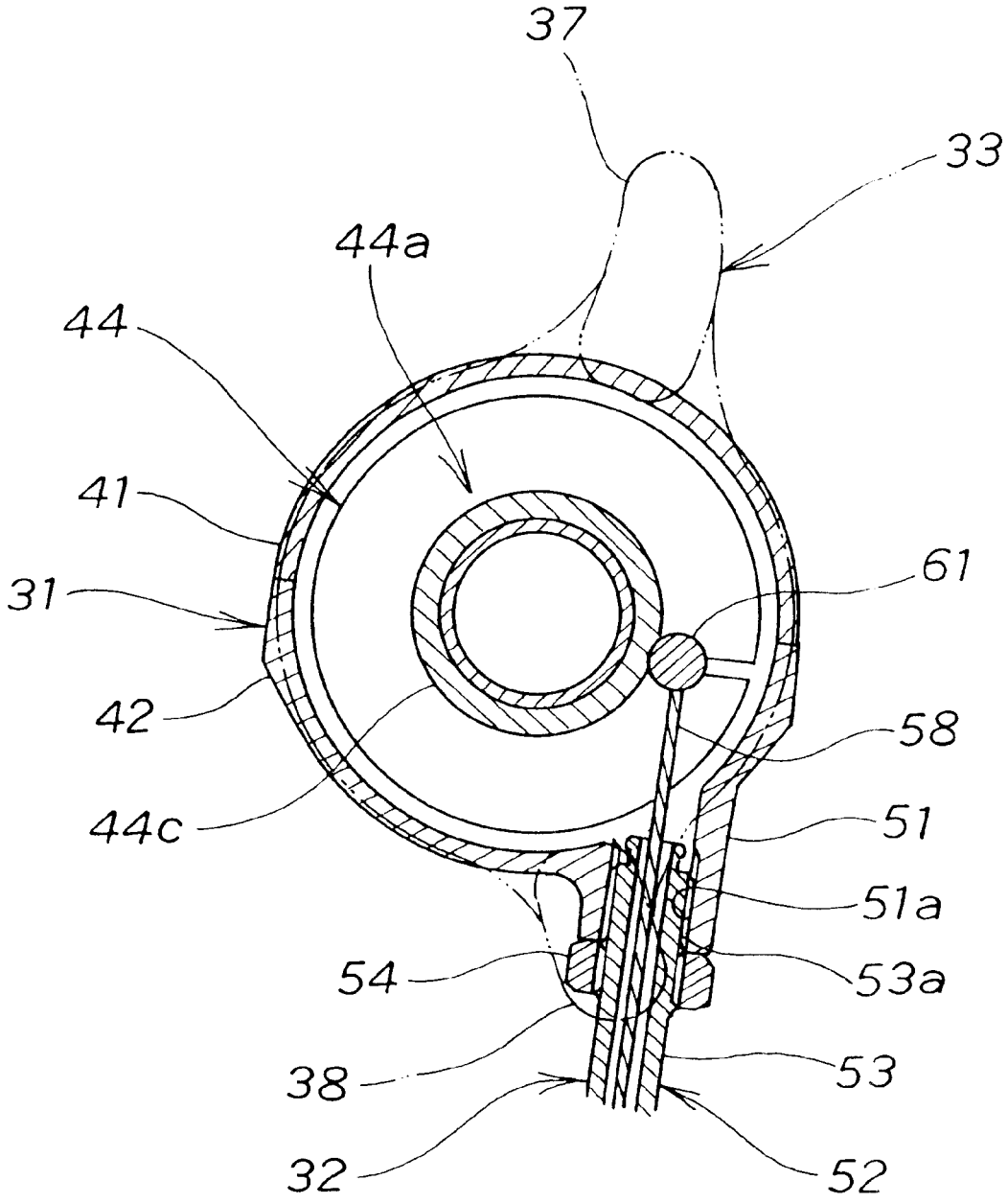
FIG. 5 is a cross-sectional view taken along line 5—5 of FIG. 2.

Turning to FIG. 5, the lower half 42 of the case 31 includes a projecting portion 51 attached to a mounting portion 52 of the throttle cable 32. The throttle cable 32 includes an outer tube 57 (see FIG. 2), and an inner wire 58 inserted movably or displaceably within the outer tube 57. The inner wire 58 has a cylindrical fitting 61 mounted on a leading end thereof. The fitting 61 is attached to the pulley 44. When the throttle lever 33 formed integrally with the pulley 44 is pivoted counterclockwise, the inner wire 58 is displaced and wound on a groove bottom 44*c* of the annular groove 44*a* formed in the pulley 44.

The mounting portion 52 includes a mounting pipe 53 having an external thread portion 53*a* formed thereon. The projecting portion 51 has an internal thread portion 51*a* formed thereon. The mounting pipe 53 is screwed into the projecting portion 51 to thereby engage the external thread portion 53*a* with the internal thread portion 51*a*. The mounting pipe 53 is secured to the projecting portion 51 by a lock nut 54. The cable 32 further includes an adjusting portion 55 (see FIG. 2) for adjusting the length of the cable 32.

Figure 6:
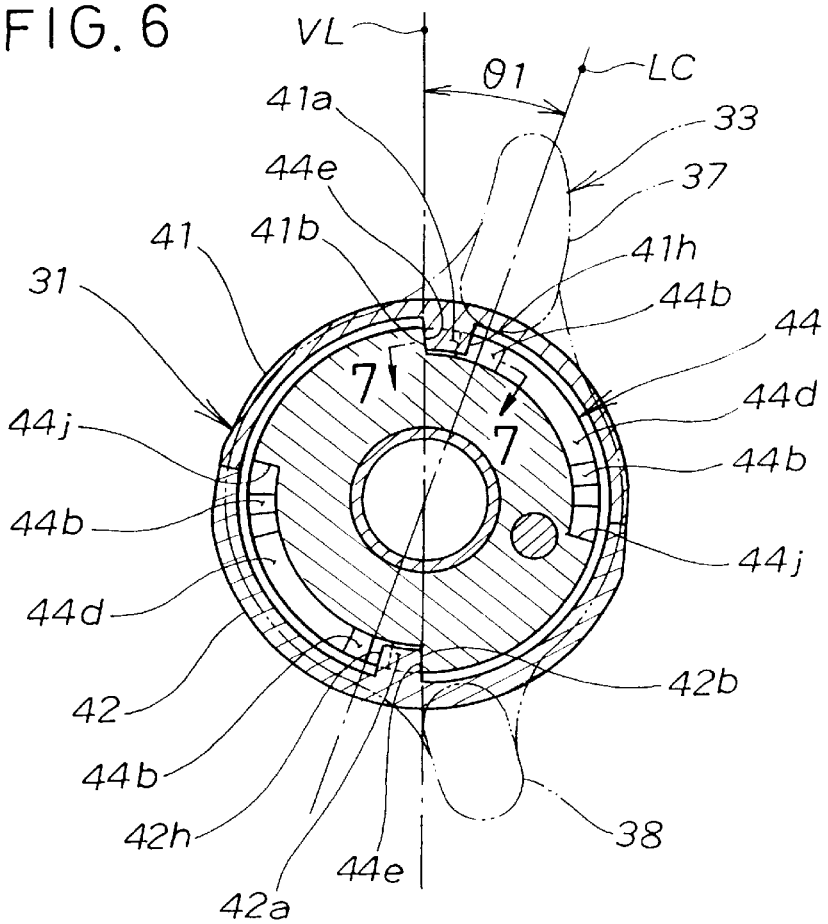
FIG. 6 is a cross-sectional view taken along line 6—6 of FIG. 4.

Referring now to FIG. 6, the case 31 has the case side cam portions 41*a*, 42*a* provided thereto while the pulley 44 has the pulley side cam portions 44*b* provided thereto. The pulley 44 and the case 31 jointly define arcuate groove portions 44*d*, 44*d*.

As shown in this Figure, the center axis LC is inclined θ1 degrees clockwise away from the vertical line VL. The pulley 44 has side walls 44*e*, 44*e*, 44*j*, 44*j*. The case side cam portion 41*a* has a side surface 41*b* which abuts against the side wall 44*e* of the pulley 44. Similarly, the case side cam portion 42*a* has a side surface 42*b* which abuts against the side wall 44*e* of the pulley 44. The case side cam portions 41*a*, 42*a* have side surfaces 41*h*, 42*h* exposed to the arcuate groove portions 44*d*, 44*d*, respectively.

Figure 7:
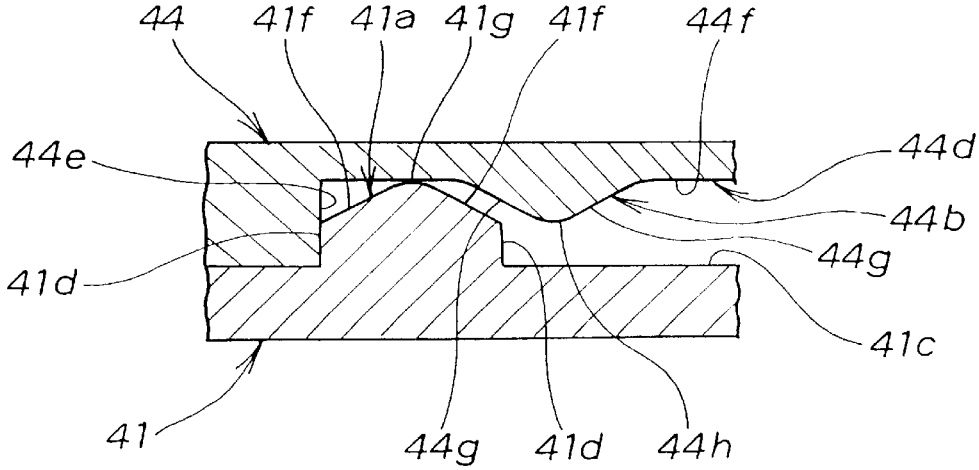
FIG. 7 is a cross-sectional view taken along line 7—7 of FIG. 6.

With reference to FIG. 7, the case side cam portion 41*a* includes vertical surfaces 41*d*, 41*d* extending perpendicularly to a side wall 41*c* of the upper half 41, inclined surfaces 41*f*, 41*f* obliquely extending from edges of the vertical surfaces 41*d*, 41*d* towards the pulley 44, and a curved portion 41*g* provided between the inclined surfaces 41*f*, 41*f*. The case side cam 42*a* is identical in configuration to the case side cam portion 41*a*, and therefore its description will be omitted.

The pulley 44 has a surface 44*f* provided in opposed relation to the side wall 41*c*. The pulley side cam portion 44*b* includes ramps 44*g*, 44*g* obliquely extending from the surface 44*f* towards the upper half 41, and a curved portion 44*h* provided between the ramps 44*g*, 44*g*.

As the throttle lever 33 (see FIG. 6) is pivoted, the pulley side cam portion 44*b* moves along the inclined surfaces 41*f* 41*f* and the curved portion 41*g* of the case side cam portion 41*a*.

Referring again to FIG. 4, the movement of the cam portion 44*b* along the inclined surfaces 41*f*, 41*f* and the curved portion 41*g* causes the pulley 44 and the throttle lever 33 to move rightwardly against a resilient force produced by the coil spring 46.

FIG. 8 shows the sequences of operations of two types of working machines: (I) a working machine which does not employ the throttle adjusting apparatus 15 and (II) the working machine 10 which employs the throttle adjusting apparatus 15.

Discussion will be made first as to the sequence of operation of the working machine which does not employ the throttle adjusting apparatus 15.

① Engine Not Operated

When the engine is not in operation, a lever for a fuel cock for supplying fuel to a carburetor is closed. An engine switch is in an off position where a spark plug is supplied with no power. Thus, no spark is produced at the plug. A choke valve is open, and hence the engine is not supplied with enriched mixture. A throttle valve for restricting the amount of the mixture to be introduced into an intake manifold of the engine is closed.

② Fuel Cock Open

Then, an operator manually turns the lever for the fuel cock to an on position to thereby open the fuel cock disposed in the proximity of a fuel tank.

③ Engine Switch On

Subsequently, the operator manually turns the engine switch to an on position.

④ Choke Valve Closed

With the engine switch held in the on position, the operator grasps a choke knob and pulls the knob to thereby close the choke valve.

⑤ Engine Started

The operator then grasps a starting grip of a recoil starter and pulls the grip to thereby make a crankshaft of the engine rotate. Upon the rotation of the crankshaft, the engine is started and warmed up.

⑥ Choke Valve Open

After the engine is warmed up, the operator pushes the choke knob back. The choke valve is thereby opened to idle the engine.

⑦ Throttle Valve Operated

A throttle lever is then pivoted by the thumb or any finger of an operator's hand to operate the throttle valve, such that the engine speed is adjusted for optimal operation of the working machine.

As is apparent from the foregoing description, these different devices, that is, the lever for the fuel cock, the engine switch, the choke knob, the starting grip, and the throttle lever should be separately handled when the engine of the working machine is started. Further, since such devices are disposed on different portions of the working machine, the operator should move a lot or change his posture each time he operates the respective devices.

Discussion will be made next as to the sequence of operation of the working machine which employs the throttle adjusting apparatus 15.

Figure 10:
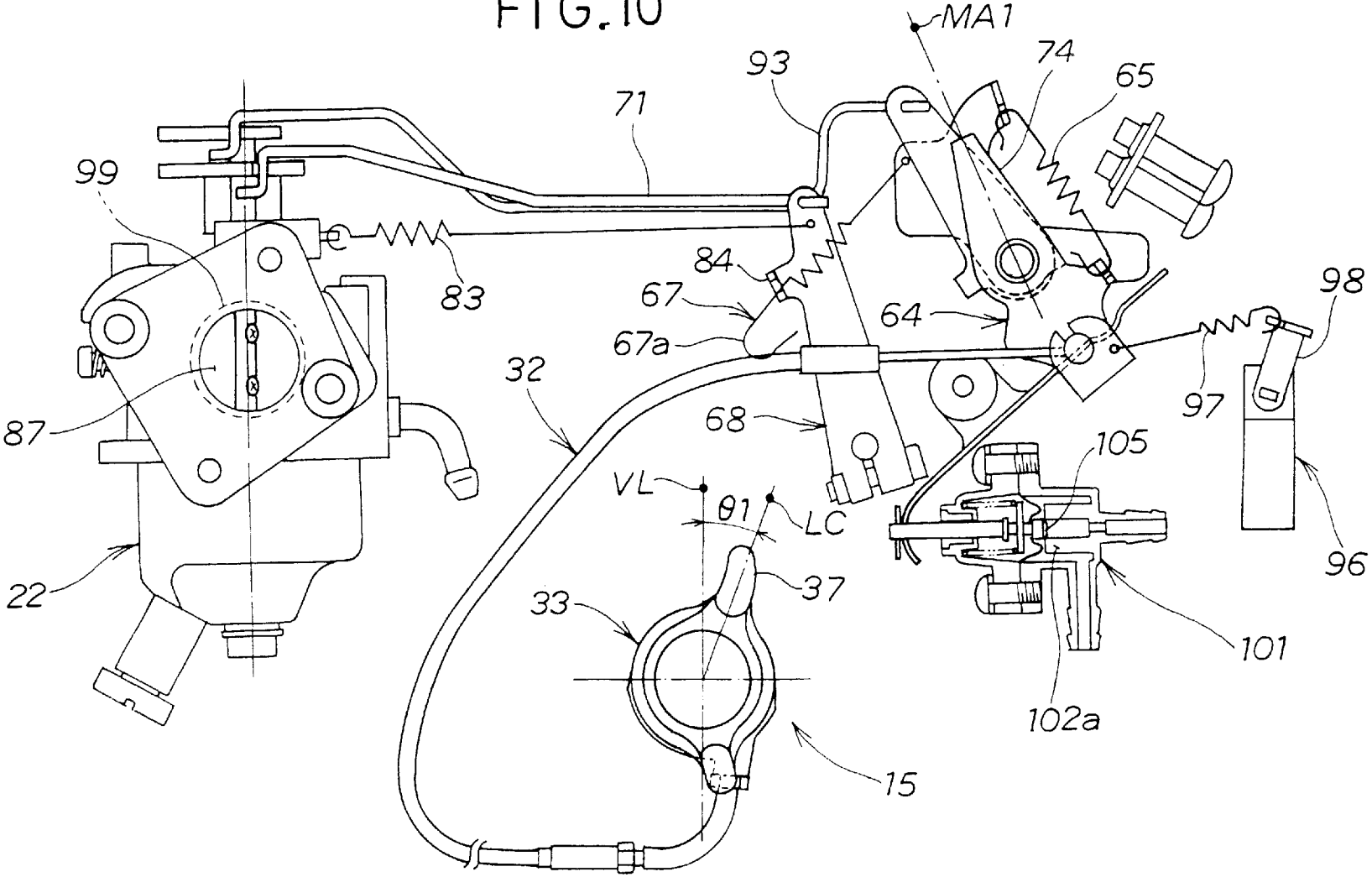
FIG. 10 is a view showing how the fuel cock, the engine switch, the choke valve, the throttle valve, and the throttle adjusting apparatus are arranged when an engine of the working machine is out of operation.

① Engine Not Operated (See FIG. 10)

When the engine 11 is out of operation, the throttle lever 33 is in the initial position. A fuel cock 101 is in a closed position. An engine switch 96 is in an off state. A choke valve 99 is in an opened position while a throttle valve 87 is opened a minimum amount.

Figure 12:
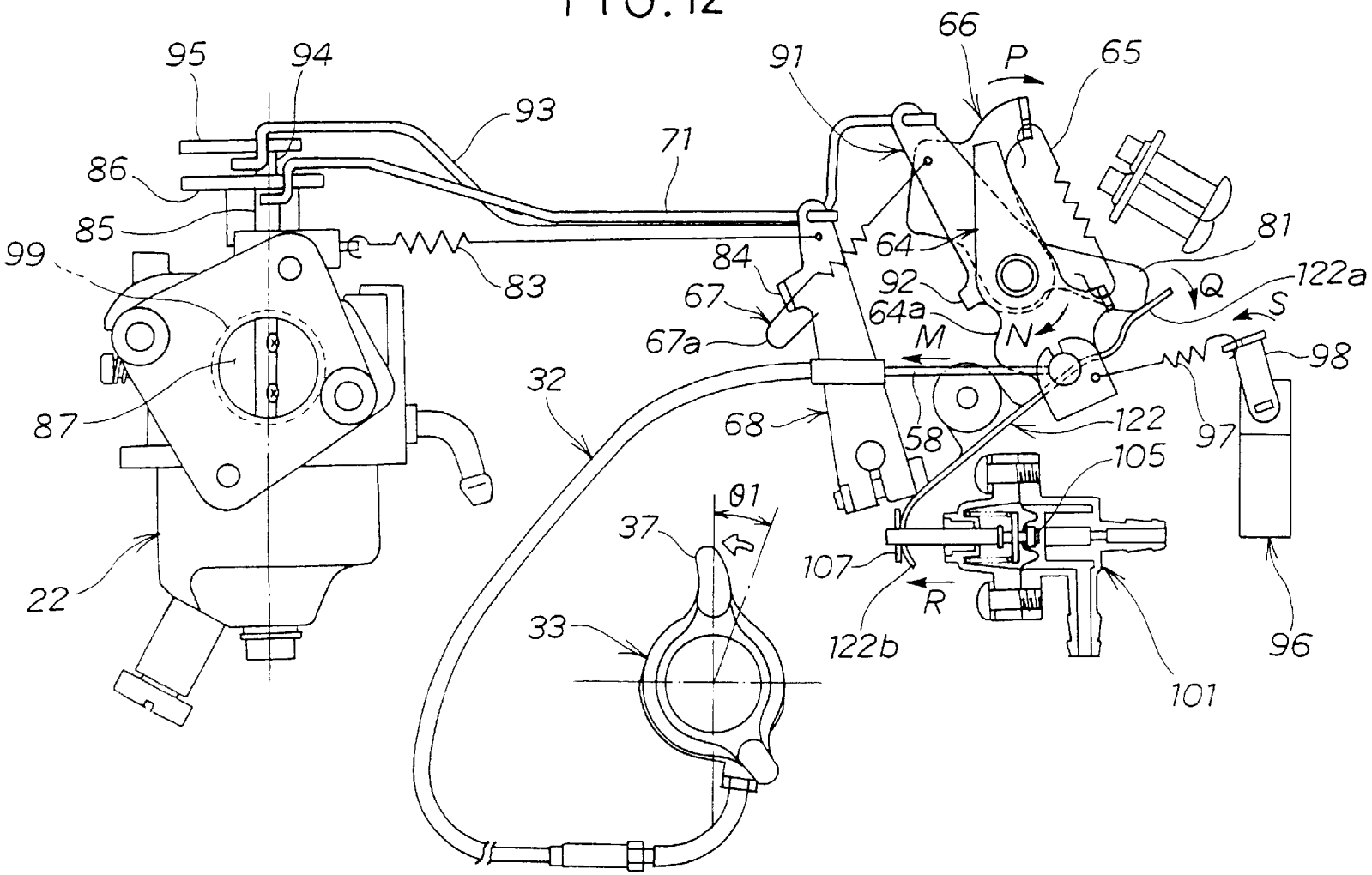
FIG. 12 is a view showing how the fuel cock, the engine switch, the choke valve, the throttle valve, and the throttle adjusting apparatus are arranged when the first lever portion is pivoted to a first position.

② Fuel Cock Open (See FIG. 12)

The throttle lever 33 is pivoted counterclockwise from the initial position to a first position. This means that the lever 33 is inclined θ1 degrees away from the initial position. At this time, the fuel cock 101 is in an opened position.

③ Engine Switch On (See FIG. 12)

With the throttle lever 33 held in the first position, the engine switch 96 is in an on state.

Figure 11:
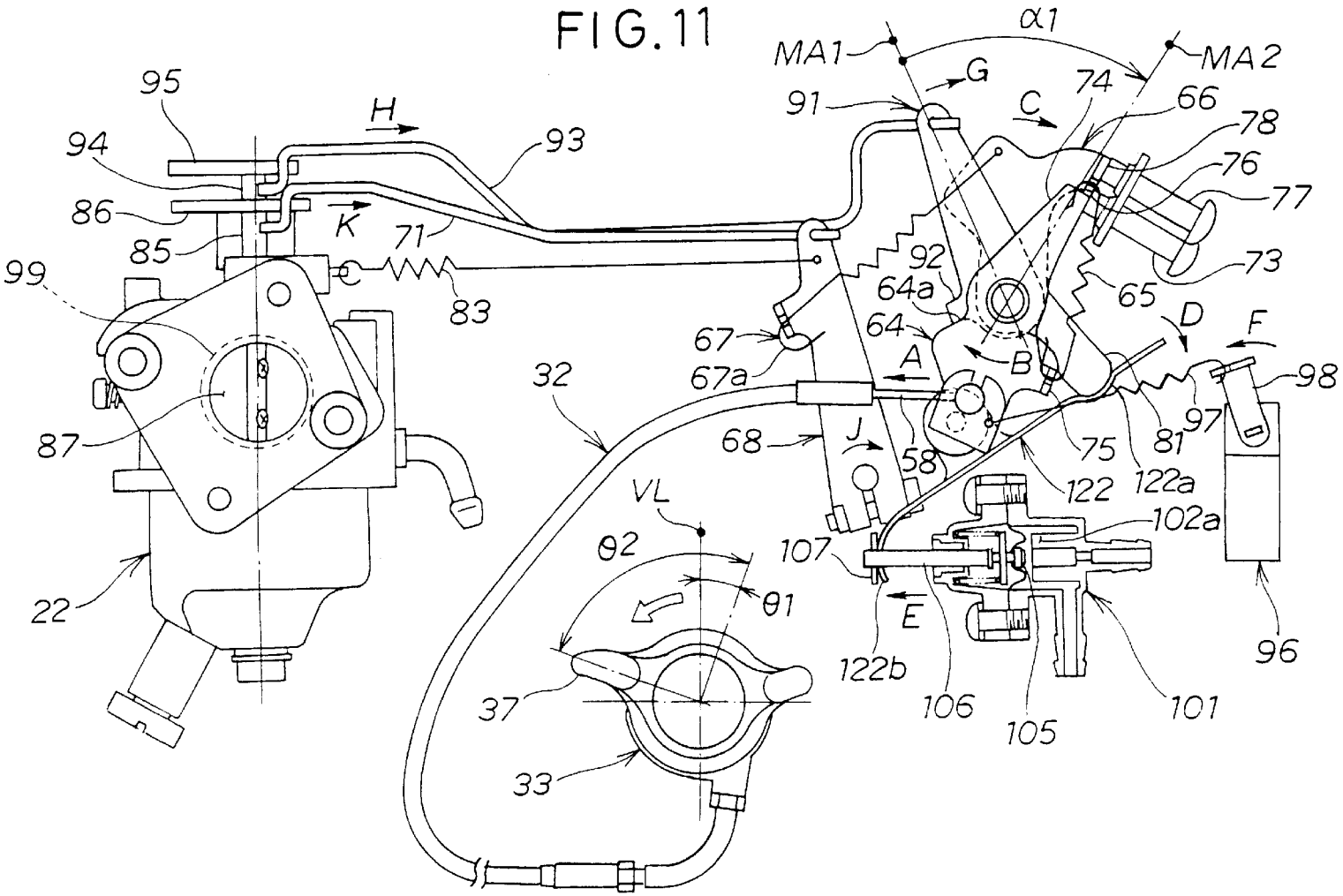
FIG. 11 is a view showing how the fuel cock, the engine switch, the choke valve, the throttle valve, and the throttle adjusting apparatus are arranged when a first lever portion of the throttle adjusting apparatus is pivoted to a second position.

④ Chock Valve Closed (See FIG. 11)

The throttle lever 33 is then pivoted counterclockwise pivoted from the first position to a second position. This means that the lever 33 is inclined θ2 degrees away from the initial position. While the lever 33 is in the second position, the choke valve 99 is in a closed position.

The throttle lever 33 can be pivoted from the initial position directly to the second position. In this case, the three functions can be achieved together: (1) The fuel cock 101 is opened. (2) The engine switch 96 is brought to the on state. (3) The choke valve 99 is closed.

⑤ Engine Started

With the throttle lever 33 held in the second position, the operator grasps a starting grip of a recoil starter of the working machine 10 and pulls the grip. A crankshaft of the engine 11 is then made to rotate, whereby the engine 11 is started.

⑥ Choke Valve Open

The throttle lever 33 is pivoted clockwise from the second position back to a third position. This means that the lever 33 is spaced θ3 degrees away from the initial position.

This pivotal movement of the lever 33 opens the choke valve 99. At this time, the throttle valve 87 is opened a maximum amount. It therefore becomes possible to open the choke valve 99 by adjusting the amount the throttle valve 87 is opened.

With the throttle lever 33 held in the third position, the machinery 10 can be used for tillage.

⑦ Throttle Valve Operated

The throttle lever 33 is pivoted clockwise from the third position back to the first position, whereby the lever 33 is inclined θ1 degrees away from the initial position. The amount by which the throttle valve 87 is opened can be made minimum.

As thus far explained, the fuel cock 101, the engine switch 96, the choke valve 99, and the throttle valve 87 can be operated with the throttle lever 33 alone.

Figure 9:
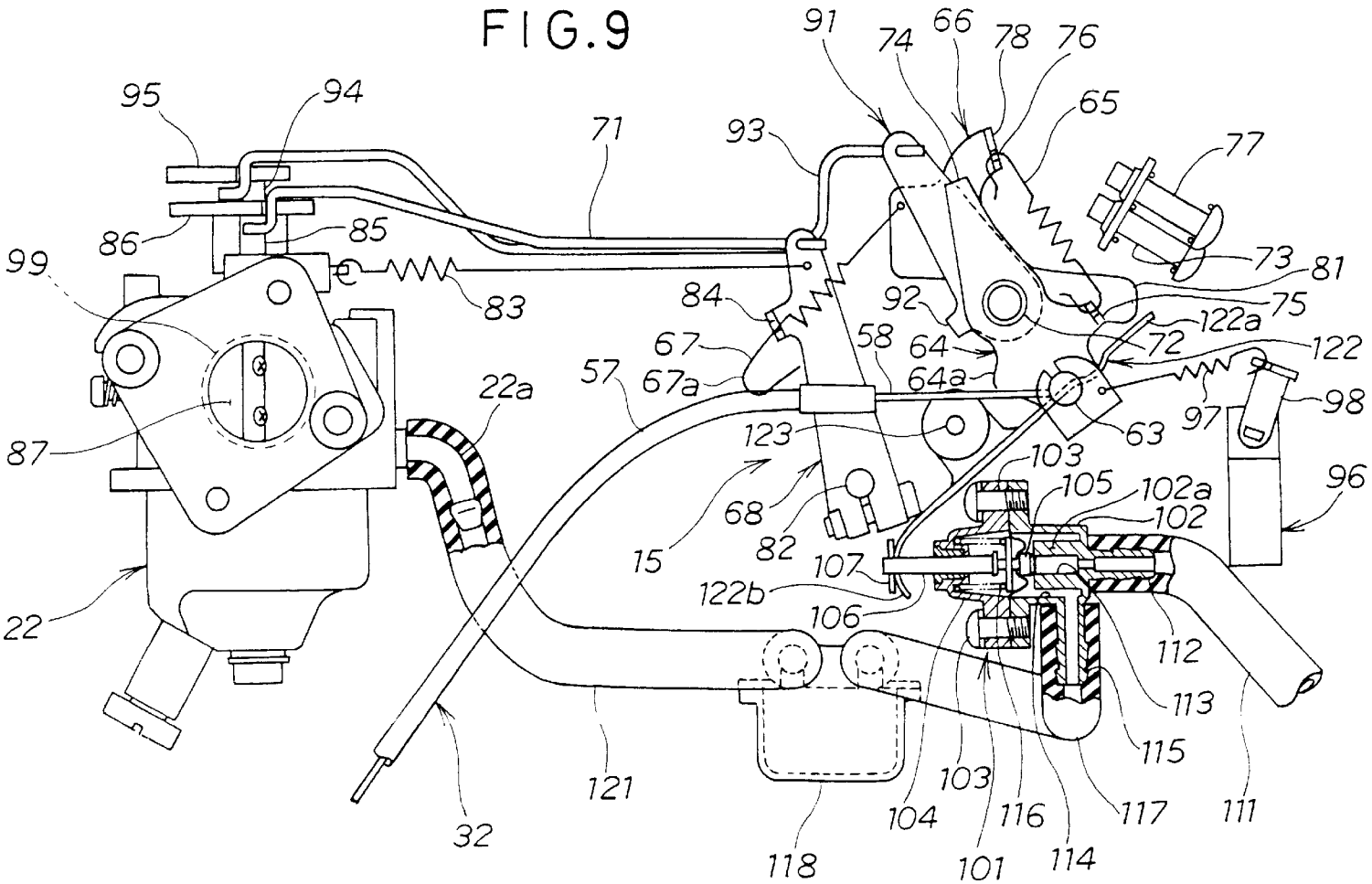
FIG. 9 is a view showing a fuel cock, an engine switch, a choke valve, and a throttle valve all of which are connected to a throttle cable of the throttle adjusting apparatus.

Referring to FIG. 9, there are shown components positioned proximate the engine 11 and the throttle cable 32 of the apparatus 15 connected thereto. The outer tube 57 (see FIG. 2) of the throttle adjusting apparatus 15 is attached to a cable mounting portion (not shown) of the engine 11. More specifically, the apparatus 15 includes a cylindrical fitting 63 connected to a trailing end of the inner wire 58, a main arm 64 having its one end portion mounted to the fitting 63, a first sub-arm 66 connected via a spring 65 to the main arm 64, a throttle adjusting arm 68 connected through a spring 67 to the first sub-arm 66, and a throttle rod 71 having one end portion connected to a leading end portion of the throttle adjusting arm 68.

The main arm 64 is pivotally mounted on a rotational shaft 72. The main arm 64 is normally urged by a spring (not shown) in such a direction as to pull the inner wire 58. The main arm 64 includes a projection portion 74 disposed to abut on a first stopper screw 73, a first spring catching portion 75 on which one end portion of the spring 65 is caught, and a bulged portion 64*a* positioned proximate the rotational shaft 72.

The first sub-arm 66 is pivotally mounted on the rotational shaft 72. The sub-arm 66 is urged by a spring (not shown) in such a manner as to pivot counterclockwise, and a stopper (not shown) holds the sub-arm 66 in the urged position. The sub-arm 66 includes a second spring catching portion 76 on which another end portion of the spring 65 is caught. The sub-arm 66 further includes a flat portion 78 provided adjacent the catching portion 76. The flat portion 78 is disposed to abut on a second stopper screw 77. The sub-arm 66 further includes a projecting piece 81 which projects away from the rotational shaft 72.

The throttle adjusting arm 68 is pivotally mounted on a swing shaft 82. The arm 68 has the leading end portion thereof connected through a spring 83 to the carburetor 22. With this arrangement, the arm 68 is urged in such a manner as to pivot counterclockwise. A stopper (not shown) holds the arm 68 in the urged position. The arm 68 further includes a third spring catching portion 84 for catching thereon an end portion 67*a* of the spring 67.

The throttle rod 71 has another end portion attached to a throttle shaft 85 mounted to an arm 86. Attached to the throttle shaft 85 is the throttle valve 87.

A second sub-arm 91 is pivotally mounted on the rotational shaft 72. A stopper (not shown) prevents the sub-arm 91 from pivoting counterclockwise. The sub-arm 91 includes a projecting portion 92 provided in the proximity of the shaft 72. The sub-arm 91 has its leading end portion connected to one end portion of a choke rod 93.

The choke rod 93 has another end portion connected to a choke shaft 94 mounted to an arm 95. Mounted on the choke shaft 94 is the choke valve 99 provided proximate an inlet port of the carburetor 22.

The engine switch 96 includes a movable portion 98 connected via a spring 97 to the one end portion of the main arm 64. When the movable portion 98 is in an on position (see FIG. 11 to FIG. 13), a spark plug positioned proximate the engine 11 is supplied with a power required to produce a spark thereat. On the other hand, when the movable portion 98 is in an off position (see FIG. 9 and FIG. 10), the supply of the power to the plug is cut off.

The fuel cock 101 includes a base portion 102, a cover portion 104 attached to the base portion 102 through screws 103, 103, a valve body 105 disposed within the base portion 102 and the cover portion 104, a rod 106 extending from the valve body 105 out of the cover portion 104, and a pin 107 provided on an end portion of the rod 106.

The base portion 102 has an intake port 112 formed therein. The port 112 communicates with a first tube 111 connected to a fuel tank (not shown). The base portion 102 further has a valve seat 102*a* through which a central oil passageway 113 extends. The passageway 113 is in communication with the port 112. The base portion 102 and the valve seat 102*a* jointly define an annular oil passageway 114. The passageway 114 extends around the valve seat 102*a*. The base portion 102 further includes a discharge port 115. The port 115 is in communication with the passageway 114. After passing through the fuel cock 101, a fuel flows out of the port 115.

Within the cover portion 104, there is disposed a spring 116 for pressing the valve body 105 against the valve seat 102*a*.

The port 115 communicates with a second tube 117. The second tube 117 is connected to a fuel filter 118. The filter 118 is connected to a third tube 121. The third tube 121 communicates with an intake port 22*a* of the carburetor 22. With this arrangement, a fuel supplied from the fuel tank flows through the first tube 111, the fuel cock 101, the second tube 117, the fuel filter 118, the third tube 121, the intake port 22*a* into the carburetor 22.

Mounted to a swing shaft 123 is a pivotal arm 122 for operating the fuel cock 101. The arm 122 has its one end portion 122*a* disposed in such a position as to be pushed by the piece 81. The arm 122 has another end portion 122*b* attached to the pin 107. When the piece 81 pushes the end portion 122*a,* the arm 122 is pivoted clockwise. This clockwise pivotal movement of the arm 122 causes the another end portion 122*b* to push the pin 107 away from the fuel cock 101. Then, the rod 106 and the valve body 105 are leftwardly moved against a resilient force produced by the spring 116. This means that the valve body 105 is moved away from the valve seat 102*a* to thereby open the fuel cock 101.

Discussion will be made as to how the various components described with respect to FIG. 9 and the throttle adjusting apparatus 15 connected to the former are operated.

Referring to FIG. 10, the first lever portion 37 of the throttle lever 33 is shown as being inclined θ1 degrees clockwise away from the vertical line VL. In other words, the lever portion 37 is in the initial position. At this point, the engine 11 is out of operation. The fuel cock 101 is closed with the valve body 105 rested on the valve seat 102*a*. The engine switch 96 is in the off state where the movable portion 98 is rightwardly inclined. The choke valve 99 is open with the choke rod 93 shifted leftwardly. The throttle valve 87 is opened the minimum amount with the throttle rod 71 shifted leftwardly. That is, the valve 87 is slightly open.

At this time, the end portion 67*a* of the spring 67 is not caught on the third spring catching portion 84 of the arm 68. Accordingly, the spring 67 does not produce any resilient force.

With the lever portion 37 positioned in the initial position, the main arm 64 has a central axis MA1 of the projection portion 74.

Turning to FIG. 11, the first lever portion 37 of the throttle lever 33 is pivoted counterclockwise from the initial position to the second position. This pivotal movement of the lever portion 37 greatly pulls the inner wire 58 of the throttle cable 32, as shown by an arrow A. The main arm 64 is then pivoted clockwise, as shown by an arrow B. This clockwise pivotal movement of the main arm 64 causes the projection portion 74 to abut against the first stopper screw 73.

The pivotal movement of the main arm 64 also causes the spring 65 to pull the catching portion 76 of the first sub-arm 66. This causes the first sub-arm 66 to pivot clockwise into abutment on the second stopper screw 77, as shown by an arrow C.

At this time, the projection portion 74 of the main arm 64 has a central axis MA2 inclined α1 degrees away from the axis MA1 as shown in FIG. 10.

The pivotal movement of the first sub-arm 66 causes the piece 81 of the arm 66 to push the one end portion 122*a* of the arm 122 downwardly. This causes the arm 122 to pivot as shown by an arrow D. Therefore, the other end portion 122*b* of the arm 122 pushes the pin 107 leftwardly.

The rod 106 of the fuel cock 101 is thus moved leftwardly, as shown by an arrow E to thereby move the valve body 105 away from the valve seat 102*a*. Consequently, the fuel cock 101 is opened.

With this arrangement, a fuel can be supplied from the fuel tank to the carburetor 22.

Further, because the main arm 64 is pivoted clockwise, the spring 97 connected to the one end portion of the main arm 64 is pulled to thereby turn the movable portion 98 leftwardly, as shown by an arrow F. Accordingly, the engine switch 96 is brought to the on state.

Furthermore, the clockwise pivotal movement of the main arm 64 presses the bulged portion 64*a* against the projecting portion 92. This causes the second sub-arm 91 to pivot clockwise, as shown by an arrow G. The clockwise pivotal movement of the sub-arm 91 pulls the choke rod 93 rightwardly, as shown by an arrow H.

The arm 95 is therefore turned to rotate the choke shaft 94. The rotation of the choke shaft 94 closes the choke valve 99.

As the first sub-arm 66 is pivoted clockwise, the end portion 67*a* of the spring 67 becomes caught on the catching portion 84 of the arm 68. The spring 67 thus pulls the arm 68, whereby the arm 68 is pivoted clockwise, as shown by an arrow J.

This clockwise pivotal movement of the arm 68 moves the throttle rod 71 rightwardly, as shown by an arrow K. The arm 86 is accordingly turned to rotate the throttle shaft 85.

Since the throttle shaft 85 is rotated, the amount by which the throttle valve 87 is opened is made maximum. That is, the throttle valve 87 is fully open.

As can be seen from FIG. 10 and FIG. 11, when the first lever portion 37 of the throttle lever 33 is pivoted from the initial position to the second position, the three functions can be achieved: (1) The fuel cock 101 is opened. (2) The engine switch 96 is brought to the on state. (3) The choke valve 99 is closed.

With the first lever portion 37 inclined θ2 degrees away from the initial position, the engine 11 can be started using the recoil starter.

Reference is made to FIG. 12. When the first lever portion 37 of the throttle lever 33 is pivoted counterclockwise from the initial position to the first position, the inner wire 58 is pulled, as shown by an arrow M. The main arm 64 is then pivoted clockwise, as shown by an arrow N. This clockwise pivotal movement of the main arm 64 causes the first sub-arm 66 to pivot clockwise, as shown by an arrow P.

The pivotal movement of the first sub-arm 66 causes the projecting piece 81 to push the one end portion 122*a* of the arm 122. The arm 122 is thereby pivoted, as shown by an arrow Q. This pivotal movement of the arm 122 causes another end portion 122*b* to push the pin 107 leftwardly, as shown by an arrow R. The fuel cock 102 is therefore opened.

Further, the pivotal movement of the main arm 64 pulls the spring 97. The movable portion 98 is thus turned leftwardly, as shown by an arrow S, to thereby bring the engine switch 96 to the on state. The choke valve 99 is open. The throttle valve 87 is opened the minimum amount.

Figure 13:
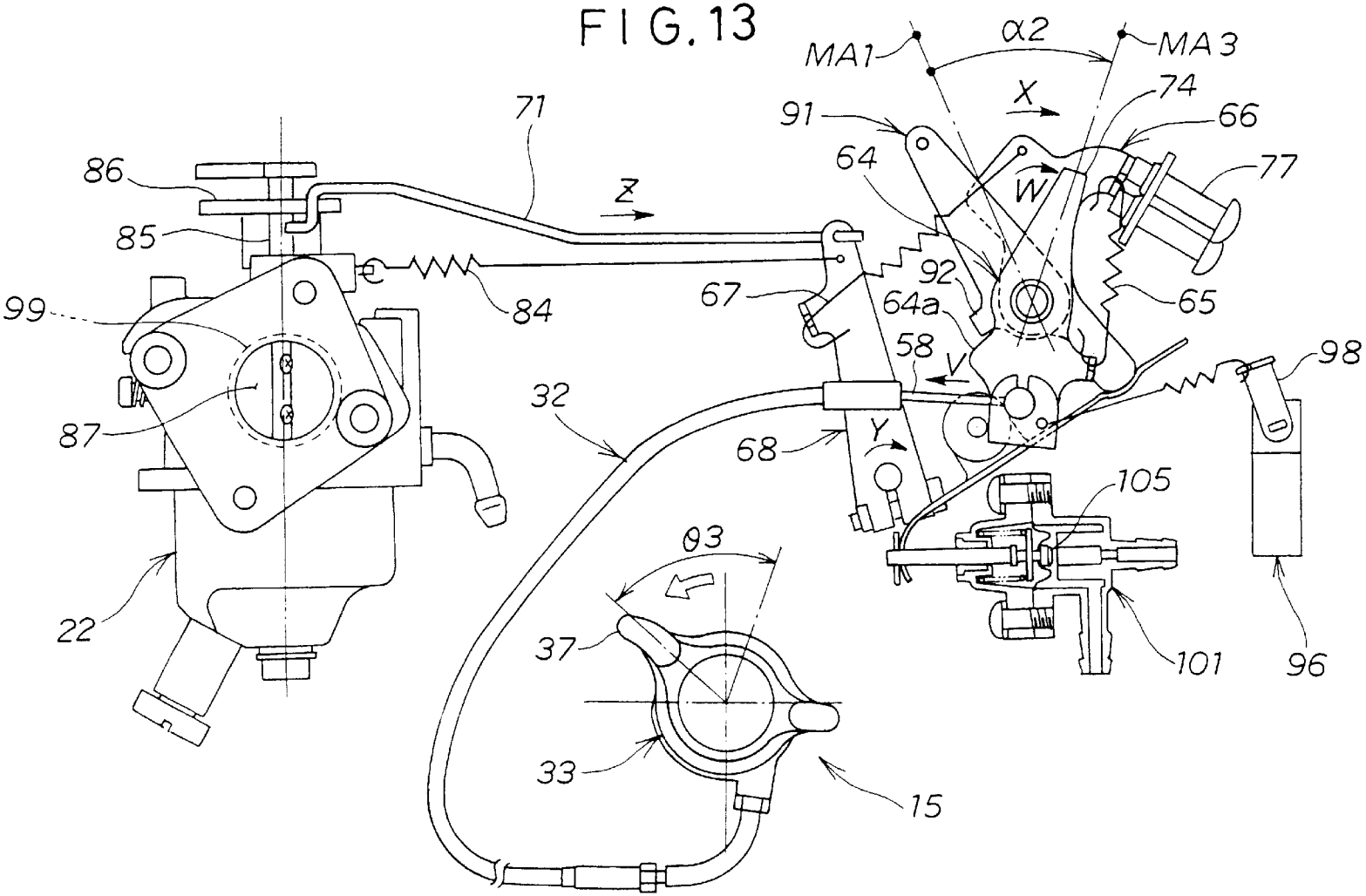
FIG. 13 is a view showing how the fuel cock, the engine switch, the choke valve, the throttle valve, and the throttle adjusting apparatus are arranged when the first lever portion is pivoted to a third position.

Turning to FIG. 13, when the first lever portion 37 of the throttle lever 33 is pivoted counterclockwise from the initial position to the third position, the inner wire 58 of the throttle cable 32 is pulled, as shown by an arrow V. The main arm 64 is thereby pivoted, as shown by an arrow W. The projection portion 74 of the main arm 64 thus pivoted has a central axis MA3 inclined α2 degrees away from the central axis MA1.

Because α2 is less than α1, the bulged portion 64*a* of the main arm 64 does not abut against the projecting portion 92 of the second sub-arm 91. Thus, the second sub-arm 91 is not pivoted. Therefore, it is not likely that the choke valve 99 is closed in the manner as discussed with respect to FIG. 11. That is, the choke valve 99 is open.

The pivotal movement of the main arm 64 causes the first sub-arm 66 to pivot, as shown by an arrow X, into abutment on the second stopper screw 77.

Meanwhile, the spring 67 is moved to pull the throttle adjusting arm 68. The arm 68 is then pivoted clockwise, as shown by an arrow Y, thereby moving the throttle rod 71 rightwardly, as shown by an arrow Z. The rightward movement of the rod 71 turns the arm 86. The throttle shaft 85 is thereby rotated to open the throttle valve 87 the maximum amount. Because the main arm 68 is pivoted clockwise, the movable portion 98 is turned leftwardly to thereby bring the engine switch 96 to the on state in the manner as previously described. Since the first sub-arm 66 is pivoted, the fuel cock 101 is opened in the manner as stated above.

The throttle lever 33 can be pivoted back to the initial position so as to bring the engine 11 out of operation.

As is apparent from the forgoing description, the throttle valve 87, the choke valve 99, the fuel cock 101, and the engine switch 96 can be operated simultaneously with the throttle lever 33 alone. Alternatively stated, with the throttle lever 33, the following plural operations can be readily accomplished: (1) The amount the throttle valve 87 is opened is made minimum and maximum. (2) The choke valve 99 is opened and closed. (3) The fuel cock 101 is opened and closed. (4) The engine switch 96 is switched between the on state and the off state. This leads to increased operational performance and working capacity of the machinery 10.

As discussed above, when the throttle lever 33 is in a minimum position where the throttle valve is opened the minimum amount, the fuel cock is in one of the closed position and opened position. When the throttle lever 33 is pivoted from the minimum position to a maximum position where the throttle valve 87 is opened the maximum amount, the choke valve 99 is in one of the closed position and the opened position.

Discussion will be made next as to operations of the case side cam portions 41*a,* 42*a,* and the pulley side cam portion 44*b.*

Figure 14B:
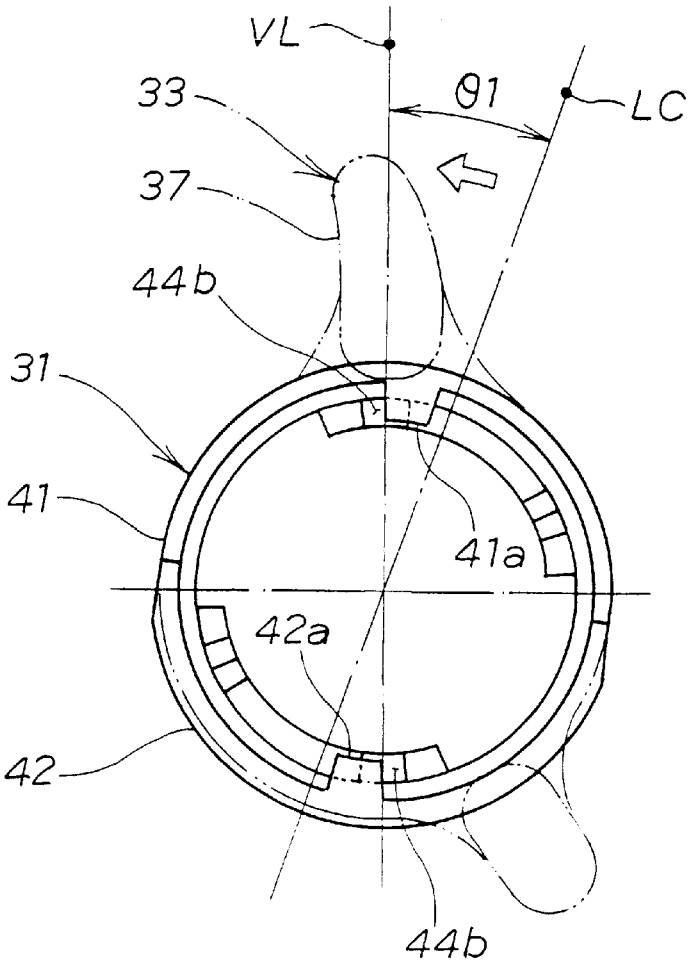
FIG. 14B is a view showing how the case side cam portion and the pulley side cam portion are operated when the first lever is pivoted to the first position.
Figure 14A:
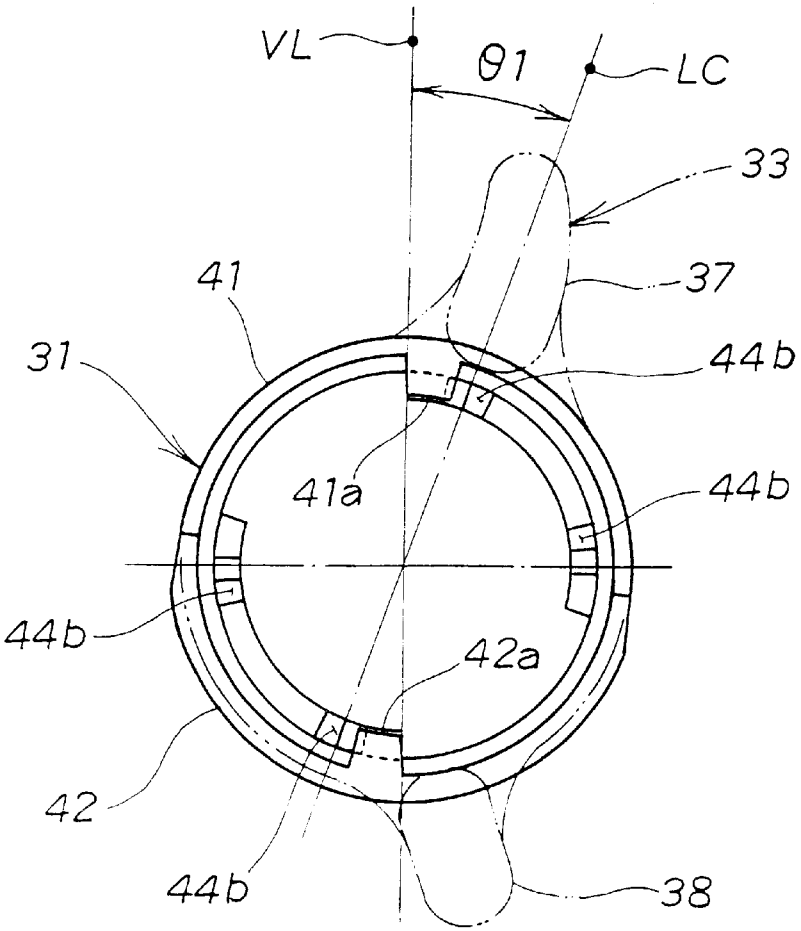
FIG. 14A is a view showing how a case side cam portion and a pulley side cam portion are operated when the first lever is in an initial position.

Referring to FIG. 14A, the first lever portion 37 of the throttle lever 33 is in the initial position. That is, the lever 33 is inclined θ1 degrees clockwise away from the vertical line VL.

As shown in FIG. 14B, when the first lever portion 37 of the throttle lever 33 is pivoted θ1 degrees counterclockwise away from the initial position, the pulley side cam portions 44*b,* 44*b* are made to move across the case side cam portions 41*a,* 42*a.*

Figure 15B:
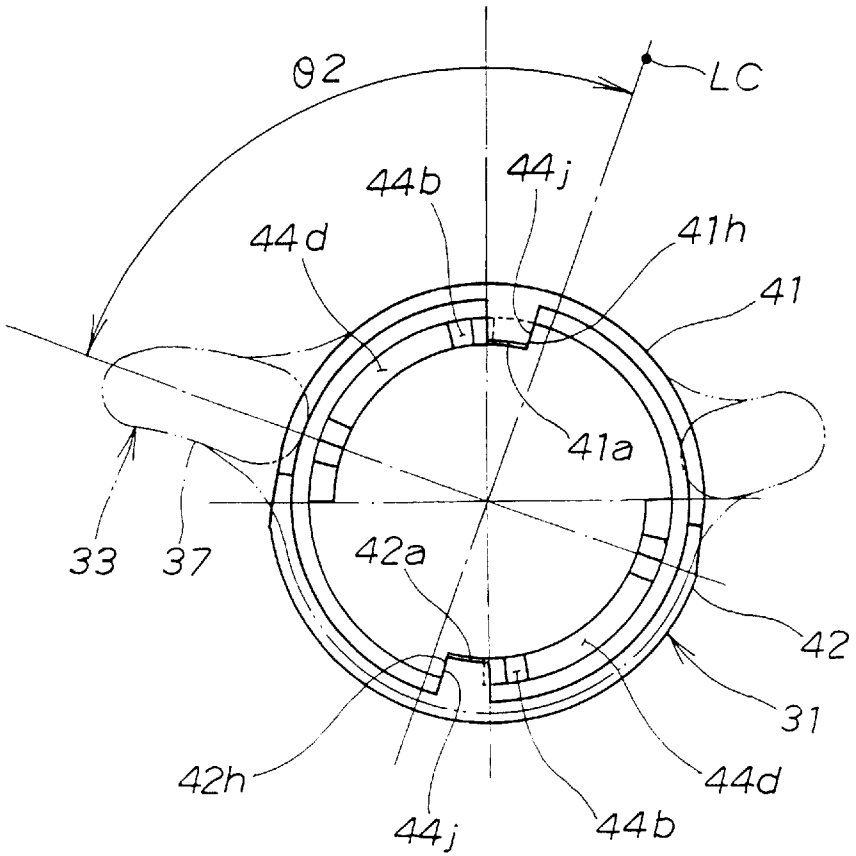
FIG. 15B is a view showing how the case side cam portion and the pulley side cam portion are operated when the first lever portion is pivoted to the second position.
Figure 15A:
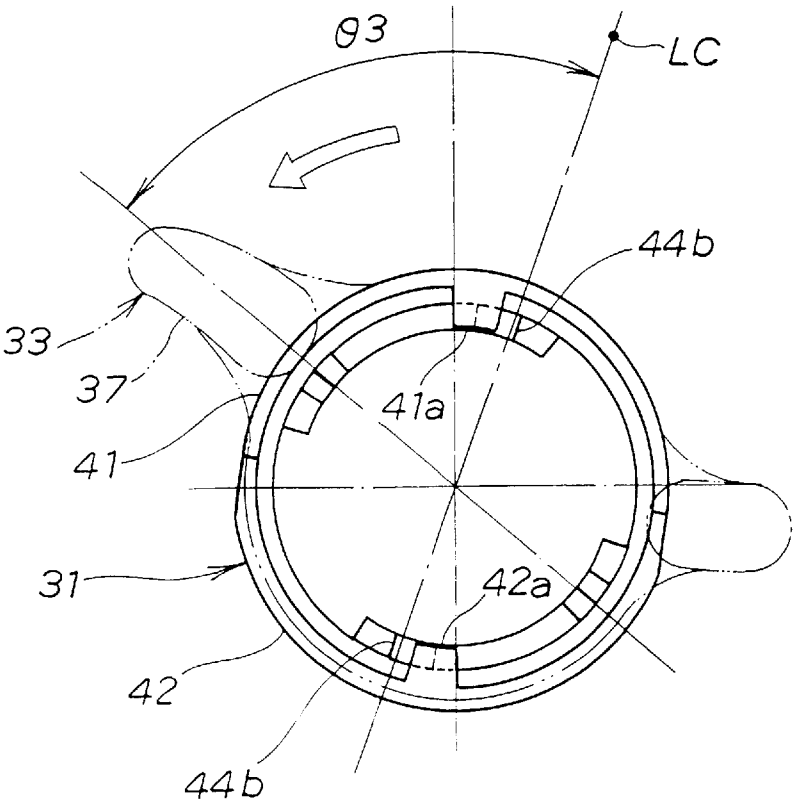
FIG. 15A is a view showing how the case side cam portion and the pulley side cam portion are operated when the first lever portion is pivoted to the third position.

Turning to FIG. 15A, when the first lever portion 37 of the throttle lever 33 is pivoted θ3 degrees counterclockwise away from the initial position, the pulley side cam portions 44*b,* 44*b* are brought into abutment on the case side cam portions 41*a,* 42*a.*

This causes the throttle valve 87 to be opened the maximum amount in the manner as described in relation to FIG. 13.

As shown in FIG. 15B, when the first lever portion 37 of the throttle lever 33 is pivoted θ2 degrees counterclockwise away from the initial position, the pulley side cam portions 44*b,* 44*b* are made to move across the case side cam portions 41*a,* 42*a,* whereupon the side walls 44*j,* 44*j* are brought into abutment on the side surfaces 41*h,* 42*h.*

This causes the choke valve 99 to be closed in the manner as stated with reference to FIG. 11.

Figure 16:
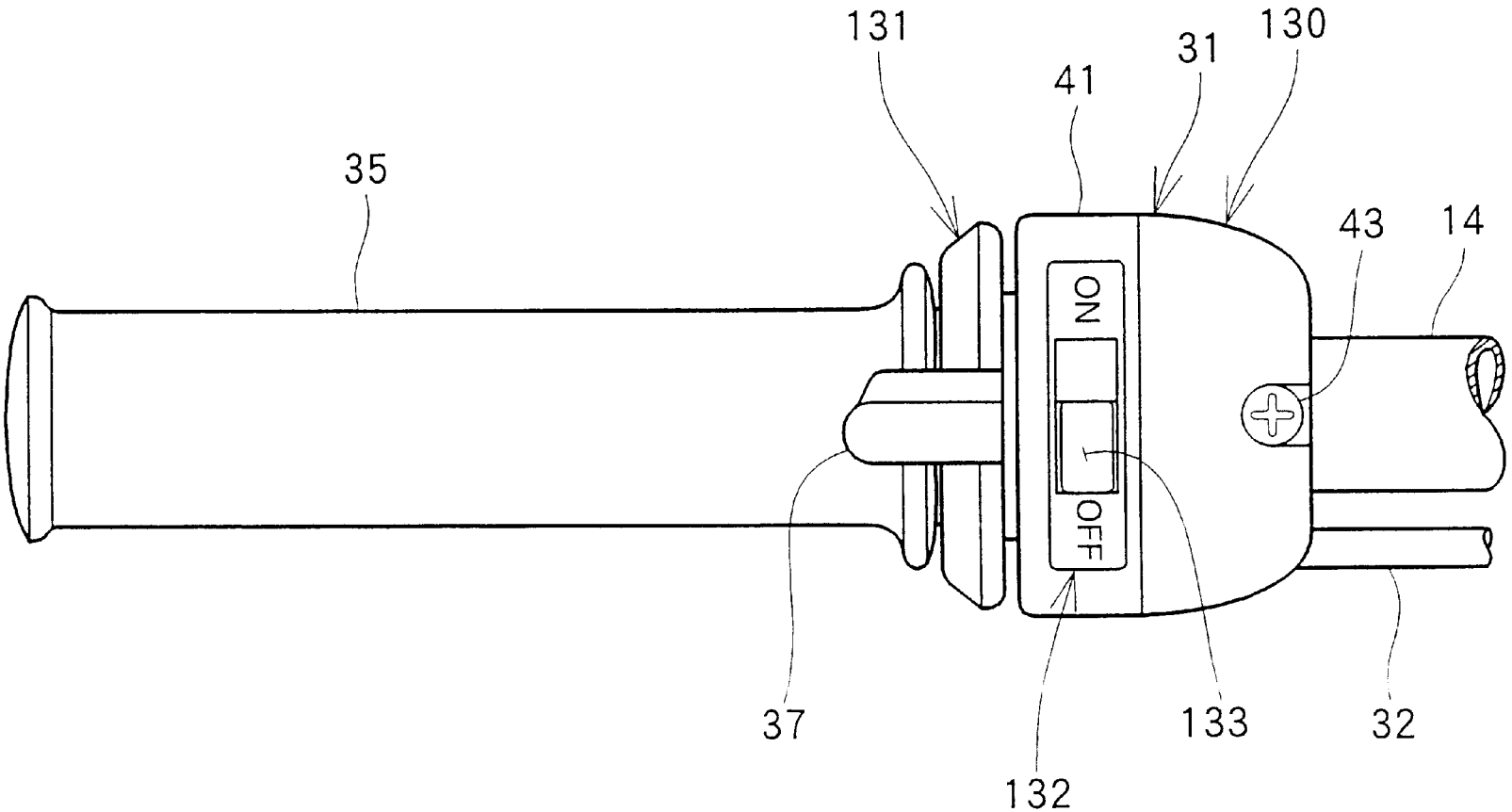
FIG. 16 shows in top plan a throttle adjusting apparatus for the working machine according to a second embodiment of the present invention.

FIG. 16 shows a throttle adjusting apparatus 130 according to a second embodiment of the present invention. The same parts as those previously described in the first embodiment are identically denoted by the same reference numerals, and their descriptions are omitted.

A throttle adjusting apparatus 130 includes a throttle cable 32 disposed along the handle 14 of the machinery 10. The throttle cable 32 has its one end mechanically connected to the respective ones of the throttle valve 87, the choke valve 99, and the fuel cock 101 in the manner as described in relation to FIG. 9. The apparatus 130 also includes a throttle lever 131 rotatable in a plane perpendicular to the longitudinal direction of the axis GC of the handle 14. Connected to the lever 131 is another end of the throttle cable 32. With this arrangement, the throttle valve 87, the choke valve 99, and the fuel cock 101 are operated simultaneously by means of the throttle lever 131 alone. On the upper half 41 of the case 31 disposed proximate the handle 14, there is mounted an engine switch 132. The engine switch 132 includes a slide portion 133 movable between an on position and an off position. When the slide portion 133 moves to the on position, the spark plug of the engine 11 is supplied with a power required to produce a spark thereat. When the engine switch 132 is in the off position, the supply of power to the spark plug is cut off.

Accordingly, the throttle valve 87, the choke valve 99, and the fuel cock 101 can be operated simultaneously with the throttle lever 131 alone in the manner as described with respect to FIG. 10 through FIG. 13.

In addition to the throttle lever 131, an operator can operate the engine switch 132 by his hand grasping the grip 35. Alternatively stated, since the engine switch 132 is disposed proximate the handle 14 rather than the engine, the operator need not bring his hand to the engine when operating the engine switch 132. This leads to improved operational performance of the machinery 10.

In the illustrated embodiment, the throttle lever 33 is pivoted counterclockwise away from the initial position so as to operate the machinery 10, however, it may be pivoted clockwise away from the initial position to pull the inner wire 58 (see FIG. 5) of the cable 32.

The throttle adjusting apparatuses 15, 130 as shown in FIG. 1 and FIG. 16, respectively, can be also used with engine-driven working machines other than the machinery 10.

Obviously, various minor changes and modifications of the present invention are possible in the light of the above teaching. It is therefore to be understood that within the scope of the appended claims, the present invention may be practiced otherwise than as specifically described.

What is claimed is:

1. A throttle adjusting apparatus for a working machine, comprising:

a throttle wire attachable to the working machine in such a manner as to extend along a longitudinal direction of a handle of the working machine, the throttle wire having one end portion connected to respective ones of a throttle valve, a choke valve, and a fuel cock; and a throttle lever pivotable in a plane perpendicular to a longitudinal direction of a grip of the handle, the throttle lever being connected to another end portion of the throttle wire, such that the throttle lever is operated to simultaneously adjust amounts by which respective ones of the throttle valve, the choke valve, and the fuel cock are opened;

wherein the fuel cock is in one of an opened position and a closed position when the throttle lever is in a minimum position where the throttle valve is opened a minimum amount, and the choke valve is in one of an opened position and a closed position when the throttle lever is pivoted from the minimum position to a maximum position where the throttle valve is opened a maximum amount.

2. A throttle adjusting apparatus as claimed in claim 1, further comprising an engine switch disposed proximate the handle of the working machine, said engine switch being operated to determine whether a spark plug of an engine of the working machine is supplied with a power required to produce a spark thereat.

3. A throttle adjusting apparatus as claimed in claim 1, wherein the one end portion of the throttle wire is connected to an engine switch such that the engine switch is switched between an on state and an off state by the throttle lever, when the engine switch is in the on state, a spark plug of an engine of the working machine being supplied with a power required to produce a spark thereat, and when the throttle lever is in the minimum position, the engine switch being in one of the on state and the off state.

4. In a working machine having a handle having a grip for manual gripping by a hand of an operator, an engine, a throttle valve for adjusting the speed of the engine, a choke valve, and a fuel cock: a throttle adjusting apparatus for coordinately adjusting the amounts by which the throttle valve, the choke valve and the fuel cock are opened, the throttle adjusting apparatus comprising a displaceable throttle wire having opposite end portions, one end portion of the throttle wire being connected to the throttle valve, the choke valve and the fuel cock; and a throttle lever pivotally mounted on the handle adjacent the grip, the throttle lever being connected to the other end portion of the throttle wire and being manually pivotable by the operator's hand while gripping the grip to displace the throttle wire to thereby coordinately adjust the amount of opening of the throttle valve, the choke valve and the fuel cock.

5. In a working machine according to claim 4; wherein the throttle lever is pivotally mounted on the handle to undergo pivotal movement from an initial position wherein the throttle valve is slightly open, the choke valve is open and the fuel cock is closed, to a first position wherein the throttle valve is slightly open, the choke valve is open and the fuel cock is open, and to a second position wherein the throttle valve is fully open, the choke valve is closed and the fuel cock is open.

6. In a working machine according to claim 5; wherein the throttle lever is pivotally mounted to undergo pivotal movement in the same direction from the initial position to the first position and then to the second position.

7. In a working machine according to claim 5; wherein the throttle lever is pivotally mounted to undergo pivotal movement to a third position wherein the throttle valve is fully open, the choke valve is open and the fuel cock is open.

8. In a working machine according to claim 7; wherein the throttle lever is pivotally mounted to undergo pivotal movement in one direction from the initial position to the first and second positions, and in a direction opposite the one direction from the second position to the third position.

9. In a working machine according to claim 5; further including an engine switch switchable between an on state for supplying electrical power to a spark plug of the engine and an off state for preventing electrial power from being supplied to the spark plug, the engine switch being connected to the one end portion of the throttle wire so that pivotal movement of the throttle lever switches the engine switch between the off and on states.

10. In a working machine according to claim 9; wherein when the throttle lever is in the initial position, the engine switch is in the off state, and when the throttle lever is in the first and second positions, the engine switch is in the on state.

11. In a working machine according to claim 5; further including an engine switch manually switchable between an on state for supplying electrical power to a spark plug of the engine and an off state for preventing electrical power from being supplied to the spark plug, the engine switch being disposed proximate the grip to enable manual switching thereof by the operator's hand while gripping the grip.

12. In a working machine according to claim 11; wherein the engine switch comprises a manually actuated slide switch.

13. In a working machine according to claim 4; further including an engine switch switchable between an on state for supplying electrical power to a spark plug of the engine and an off state for preventing electrial power from being supplied to the spark plug, the engine switch being connected to the one end portion of the throttle wire so that pivotal movement of the throttle lever switches the engine switch between the off and on states.

14. In a working machine according to claim 4; further including an engine switch manually switchable between an on state for supplying electrical power to a spark plug of the engine and an off state for preventing electrical power from being supplied to the spark plug, the engine switch being disposed proximate the grip to enable manual switching thereof by the operator's hand while gripping the grip.

15. In a working machine according to claim 14; wherein the engine switch comprises a manually actuated slide switch.

* * * * *